US007674194B2

(12) United States Patent
Lortscher

(10) Patent No.: US 7,674,194 B2
(45) Date of Patent: Mar. 9, 2010

(54) BASEBALL SWING TRAINING AID

(76) Inventor: Lane Lortscher, 18037 Martha St., Encino, CA (US) 91316

( * ) Notice: Subject to any disclaimer, the term of this patent is extended or adjusted under 35 U.S.C. 154(b) by 159 days.

(21) Appl. No.: 11/940,955

(22) Filed: Nov. 15, 2007

(65) Prior Publication Data

US 2008/0064534 A1 Mar. 13, 2008

Related U.S. Application Data

(63) Continuation-in-part of application No. 11/428,931, filed on Jul. 6, 2006, now Pat. No. 7,510,491, which is a continuation-in-part of application No. 11/306,984, filed on Jan. 18, 2006.

(51) Int. Cl.
*A63B 69/40* (2006.01)
*A63B 69/00* (2006.01)

(52) U.S. Cl. ..... 473/417; 473/422; D21/715

(58) Field of Classification Search ..... 473/417, 473/422, 431, 451, 387; 124/16, 17, 37
See application file for complete search history.

(56) References Cited

U.S. PATENT DOCUMENTS 1,739,425 A * 12/1929 Stefan ..... 108/39
1,823,992 A * 9/1931 Smith ..... 473/396
2,527,906 A 10/1950 Bennett, Jr. et al.
3,474,771 A * 10/1969 Breslow et al. ..... 124/16
3,596,866 A * 8/1971 Baker ..... 248/461
3,874,554 A * 4/1975 Chang ..... 220/708
3,952,477 A * 4/1976 Candor et al. ..... 53/452
4,000,900 A * 1/1977 Lehmann ..... 273/126 R
4,148,455 A * 4/1979 Oliver ..... 248/524
4,176,838 A 12/1979 Griffin
4,758,001 A * 7/1988 Otting et al. ..... 473/266
4,832,163 A * 5/1989 Levesque ..... 190/11
4,901,998 A * 2/1990 Griffith ..... 473/417
5,158,281 A * 10/1992 Williams ..... 473/483
5,197,623 A * 3/1993 Wang ..... 220/212
5,207,407 A * 5/1993 Fitzsimmons et al. ..... 248/519
5,221,089 A * 6/1993 Barrett ..... 473/215
D349,007 S * 7/1994 Costello ..... D7/605
5,375,828 A * 12/1994 Shikami ..... 273/110
5,377,976 A * 1/1995 Matherne et al. ..... 473/483
5,427,346 A * 6/1995 Urgola ..... 248/519
5,540,430 A * 7/1996 Nichols et al. ..... 473/418
5,672,124 A 9/1997 Pecoraro et al.
5,705,212 A * 1/1998 Atkinson ..... 426/115
5,759,119 A * 6/1998 Ayoub ..... 473/387
6,296,581 B1 * 10/2001 Sever ..... 473/422
6,413,175 B1 7/2002 Mooney, Jr.
6,565,459 B2 * 5/2003 Gormley ..... 473/423
6,604,645 B1 * 8/2003 Vaupotic ..... 220/212

(Continued)

*Primary Examiner*—Mitra Aryanpour
(74) *Attorney, Agent, or Firm*—Kelly Lowry & Kelley LLP

(57) ABSTRACT

A baseball swing training aid includes a housing and a lid for retaining a batting tee in a first or storage configuration and in a second or use configuration. In the first configuration, the batting tee is stowable on an underside of the lid such that the tee does not interfere with the lid's attachment to the housing. In the second configuration, the batting tee base attaches to a slot formed in the lid to extend the tee upwardly for baseball swing training. Accordingly, the tee is easily changeable between the first and second configurations for fast setup, storage or transportation.

18 Claims, 5 Drawing Sheets

U.S. PATENT DOCUMENTS 6,682,445 B1 1/2004 Tanner
6,895,982 B1 * 5/2005 Shaw ..... 135/16
6,929,556 B1 * 8/2005 Wolbert ..... 473/137
D509,551 S * 9/2005 Reynolds ..... D21/715
6,968,955 B2 * 11/2005 Steeber ..... 206/702
7,226,372 B2 * 6/2007 Flanigan ..... 473/417
7,252,195 B2 * 8/2007 Mandle et al. ..... 206/494
7,255,658 B1 * 8/2007 VanKuiken et al. ..... 473/454
2004/0112774 A1 * 6/2004 Winkler ..... 206/315.2
2005/0011105 A1 * 1/2005 Cameron et al. ..... 43/17
2005/0145534 A1 * 7/2005 Steeber ..... 206/702
2007/0045964 A1 * 3/2007 Petras ..... 273/317
2007/0184921 A1 * 8/2007 Smith ..... 473/453
2009/0008390 A1 * 1/2009 Robinson ..... 220/212

* cited by examiner

BASEBALL SWING TRAINING AID

BACKGROUND OF THE INVENTION

The present invention generally relates to a baseball swing training aid. More particularly, the present invention relates to a baseball swing training aid having a collapsible tee for storage within the lid of the corresponding container.

Baseball tees designed to aid in the training of a batting swing are generally known in art. For example, U.S. Pat. No. 4,176,838 to Griffin discloses a baseball batting tee having a self-righting, semi-spherical weighted bottom portion with an axially upstanding post removably fixed thereto. An inverted conical helical spring attached at the top of the post is configured for reception of a ball thereon. The semi-spherical weighted bottom portion helps maintain the post in a substantially upright position as a batter swings through the ball. The weighted bottom portion helps offset any force against the post in the event that the tee is struck during the course of a swing. But, the tee disclosed in the '838 patent is not collapsible for easy portability or storage.

In another example, U.S. Pat. No. 5,672,124 to Pecoraro discloses an automatic batting tee apparatus having a housing capable of gravity feeding a plurality of balls onto an associated tee. Reloading the top of the tee is accomplished by actuating a lever mechanism that dispenses a ball from the housing and onto the tee. The balls are fed through this housing during operation, but the tee itself is not able to store balls within its housing during transportation.

Moreover, U.S. Pat. No. 6,413,175 to Mooney discloses a batting tee having a ball mount position lower relative to the other batting tee components. The batting tee includes a base, an upright support, and a swing arm wherein the mount for the ball is integral to the end of the swing arm opposite the end mounted to the upright support. The swing arm is pivotally and telescopically movable relative to the upright so that the vertical height of the ball position may be varied. Most notably, this batting tee is bulky and incapable of storing balls.

Lastly, U.S. Pat. No. 6,682,445 to Tanner discloses a durable batting tee having an elongated split washer to provide friction between telescoping parts in the stem without requiring tightening adjustments by a user. While the disclosed batting tee is collapsible, the tee is not capable of storing a number of balls therein for portability.

Accordingly, there is a need for a baseball swing training aid that is collapsible and capable of storing a plurality of balls therein to increase portability. Such a baseball swing training aid should also be compact to ease transportation and storage. There is an additional need for a baseball swing training aid that is easily movable between storage and use configurations and that relies on minimal support for maintaining the tee in an upright configuration. Accordingly, such a baseball swing training aid should include a collapsible tee storable within the container lid to prevent interference with the balls stored within the container during storage. There is a further need for a baseball swing training aid that is economical and easy to manufacturer. The present invention fulfills these needs and provides further related advantages.

SUMMARY OF THE INVENTION

A baseball swing training aid is herein provided that includes a housing and corresponding lid capable of storing a batting tee. The lid effectively encases the housing and any balls stored therein. The batting tee comprises a base, a ball holder, and an elongated member extending from the base to the ball holder. This tee is used in conjunction with the lid for storage and use. In a preferred embodiment, the batting tee is stowable on an underside of the lid in a first configuration such that the batting tee does not interfere with attachment of the lid to the housing. In a second configuration, the batting tee attaches to the lid such that the elongated member extends upwardly from the base to position the ball holder at a desired height for baseball swing training.

Furthermore, in the first configuration, the batting tee removably attaches to the lid via a snap-fit or friction-fit configuration. In this embodiment, the batting tee slips into or otherwise snappingly engages a channel or other depression formed within the underside of the lid. The opening of the channel may be slightly smaller in diameter than the diameter of the baseball tee. Accordingly, the location blocks that encase the batting tee within the lid may be slightly deformable to enable insertion of the batting tee. This ensures that the tee remains substantially affixed within the channel during transportation or use.

A channel or other threaded member formed in the lid engages a corresponding rim formed at the top of the housing, for removable attachment thereto. The rim and channel may engage one another via a screw-type, snap-fit or friction-fit coupling. This coupling is preferably durable and able to sufficiently retain the lid relative to the housing during transportation. The coupling is preferably designed to enable easy and quick attachment or detachment.

In the second configuration, the base of the batting tee removably engages a slot formed in the underside of the lid. This ensures that the elongated member is retained in a substantially upright position when used as a baseball swing training aid. The lid further includes a lock that secures the base within the slot prior to use thereof. The lock prevents the batting tee from rotating or otherwise disconnecting from the lid during use. Without the lock, the tee and corresponding base may easily rotate out of the slot formed within the lid.

The elongated member portion of the batting tee is selectively telescopingly movable between an extended position and a retracted position. The desired batting tee height between the extended position and the retracted position is adjustably retained via a fastener or other comparable device. The height of the elongated member ultimately depends upon the size and preference of the person using the baseball swing training aid. Preferably, the fastener has a screw-tight, snap-fit, friction-fit or mechanical coupling that substantially retains the elongated member at the desired height during use. The coupling should otherwise be easily disengageable after use so that the user may quickly and efficiently restow the batting tee back within the lid.

In an alternative embodiment, and to further ease in the storage of the batting tee within the lid, the elongated member includes a top portion selectively separable from a bottom portion. Accordingly, the separated top and bottom portions reside within a pair of channels formed in the lid bottom. This ensures that the baseball swing training aid is able to accommodate a full range of users as the elongated member contains two extendable portions thereof. A flexible cord interconnects the interiors of the separated top and bottom portions such that each portion may be offset within the lid. Hence, the lid can be compact for storage and transportation. A conical ball holder may also be used to retain the batting tee within one of the aforementioned channels. The conical ball holder is ideal for placement of a baseball, softball, wiffle ball or any other comparable ball that could be used with the baseball swing training aid of the present invention.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
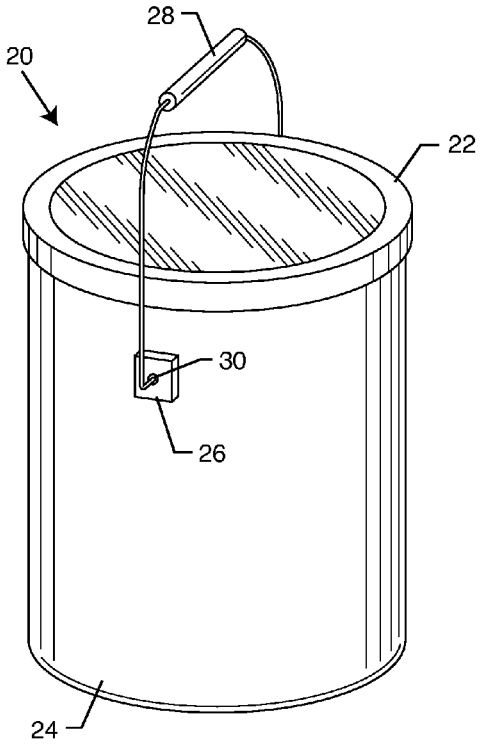
FIG. 1 is a perspective view of a baseball swing training aid ready for storage.

As shown in the drawings for purposes of illustration, the baseball swing training aid of the present invention is referred to generally by the reference number 20. FIG. 1 illustrates the baseball swing training aid 20 having a lid 22 and a housing 24. The housing 24 includes an attachment member 26 for rotatably coupling a handle 28 to the housing 24. The handle 28 is capable of rotating relative to the housing 24 and relative to the attachment member 26 by means of an aperture 30 located within the attachment member 26. The handle 28 is symmetrically attached to the exterior of the housing 24 via a similar attachment member and corresponding aperture as hidden in FIG. 1. Moreover, the handle 28 pivots relative to the housing 24 over the lid 22, and is preferably formed from a wire similar to, if not identical to, a wire handle commonly used with conventional paint cans. Such a handle 28 is of simple construction, lightweight and compact, which are all desirable features of the present invention. It is merely preferable that the handle 28 rotate relative to the housing 24 and corresponding lid 22 via the attachment member 26 and corresponding aperture 30. A person of ordinary skill in art will readily recognize that a substantially rigid handle 28 is also compatible with the present invention. Such a rigid handle must allow the lid 22 to release from the housing 24 as described herein. Essentially, any variety of handle known in the art may be used with the present invention pending the lid 22 is releasable from the housing 24.

Figure 2:
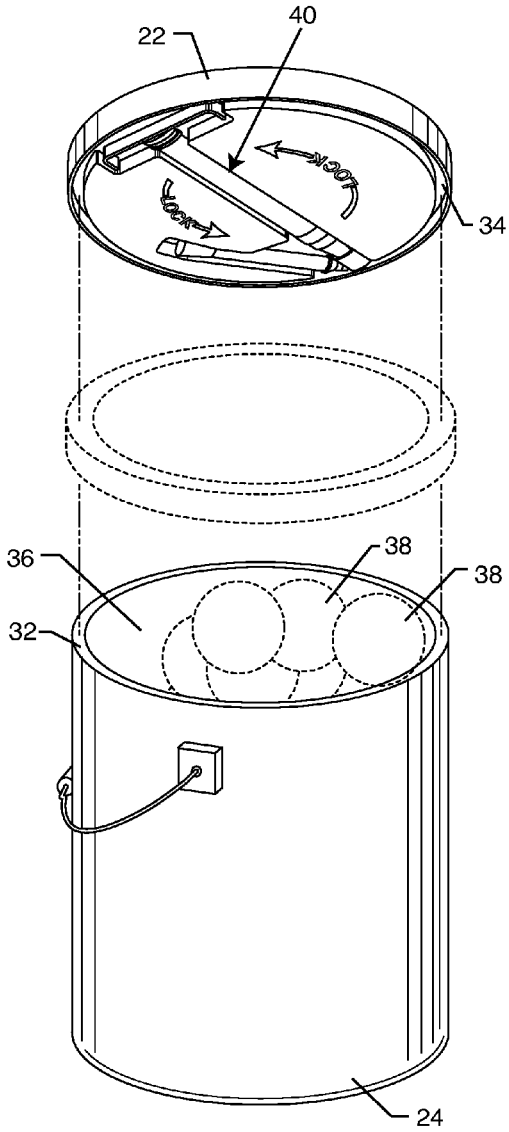
FIG. 2 is a partially exploded view of the baseball training aid, of FIG. 1, illustrating a tee stored within a container lid.

In a preferred embodiment, the lid 22 attaches to the housing 24 via a snap-fit, screw-tight, friction-fit or other comparable attachment or coupling known in the art. FIG. 2 is a perspective view showing removal of the lid 22 from the housing 24. A rim 32 of the housing 24 is configured to receive a channel 34 for effectively retaining the lid 22 relative to the housing 24. This may entail that the lid 22 be slightly flexible so that the channel 34 fits snuggly to the rim 32 such that lid 22 remains substantially affixed to the housing 24 before removal therefrom. Alternatively, the channel 34 and corresponding rim 32 may include additional engagement slots (not shown) that enable the lid 22 to snap into the housing 24. Alternatively, the channel 34 and corresponding rim 32 may be replaced by a pair of matching threads to enable the lid 22 to screw into the housing 24 to form a screw-tight seal.

The housing 24 has an interior chamber 36 for storing a plurality of balls 38 therein. The balls 38 stored within the interior chamber 36 could encompass baseballs, softballs, basketballs, soccer balls, footballs, tennis balls, or virtually any other type of ball known in the art. Round balls 38, as shown, are merely preferable. Likewise, the interior chamber 36 of the housing 24 is preferably used to store multiple baseballs or softballs for use with a batting tee 40 integral to the baseball swing training aid 20. The interior chamber 36 does not need to leave room for the batting tee 40. Instead, the batting tee 40 is stored completely within the lid 22 such that the batting tee 40 does not interfere with volume formed by the interior chamber 36 when the lid 22 is secured to the housing 24. This advantageously frees space within the interior chamber 36 for storage of the balls 38. This also allows the lid 22 to sufficiently fit or snap onto the corresponding housing 24 without interference of the items carried within the interior chamber 36.

Figure 3:
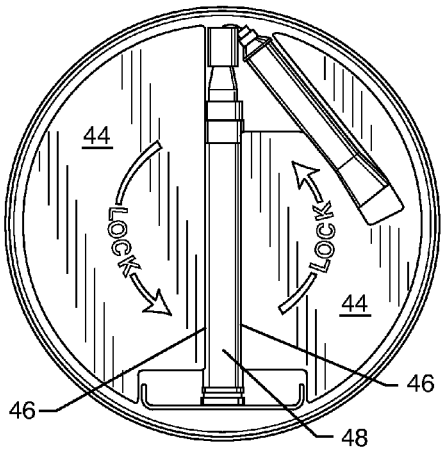
FIG. 3 is a bottom view of the lid shown in FIG. 2.
Figure 4:
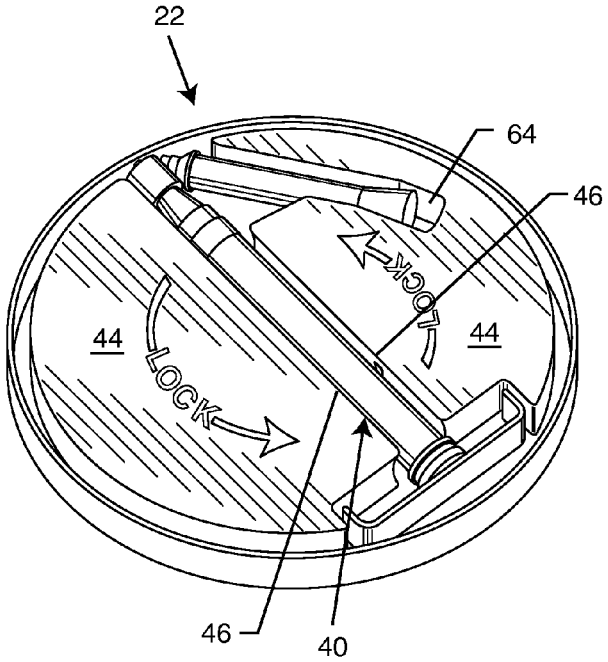
FIG. 4 is a perspective view of the bottom of the lid shown in FIG. 2.

As generally shown in FIGS. 2-4, the batting tee 40 is stored integral to the lid 22. As best shown in FIGS. 3 and 4, the batting tee 40 snaps into a retainment channel 42. The retainment channel 42 is a semi-spherical channel formed between a pair of location blocks 44. A pair of upper edges 46 of the location blocks 44 are slightly deformable to allow the main body 48 of the batting tee 40 to snap into the retainment channel 42. As shown in FIG. 3, the width of the main body 48 is wider than the gap formed between the pair of upper edges 46 formed as part of the location blocks 44. This ensures that when the lid 22 is affixed to the housing 24, as previously described, the batting tee 40 stays retained between the location blocks 44. Placing the batting tee 40 within the retainment channel 42 further facilitates the compact nature of the present invention. In essence, the batting tee 40 is non-obstructive to the contents of the interior chamber 36 of the housing 24. In a preferred embodiment, the batting tee 40 remains substantially flush within the interior of the lid 22 as between the location blocks 44.

Figure 5:
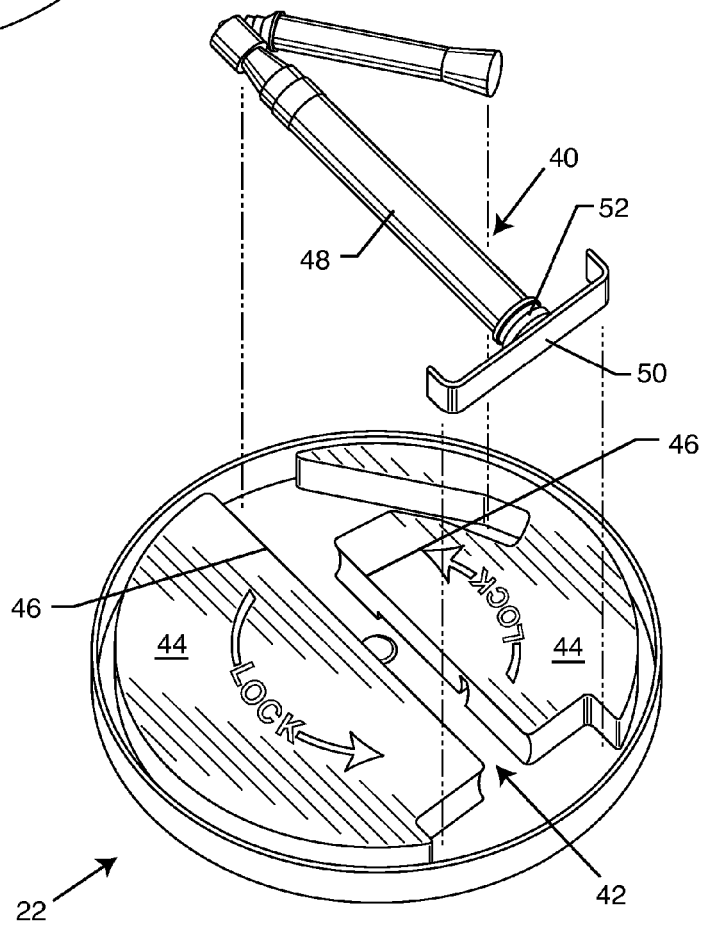
FIG. 5 is an exploded view of FIG. 4, showing the batting tee removed from the lid.
Figure 6:
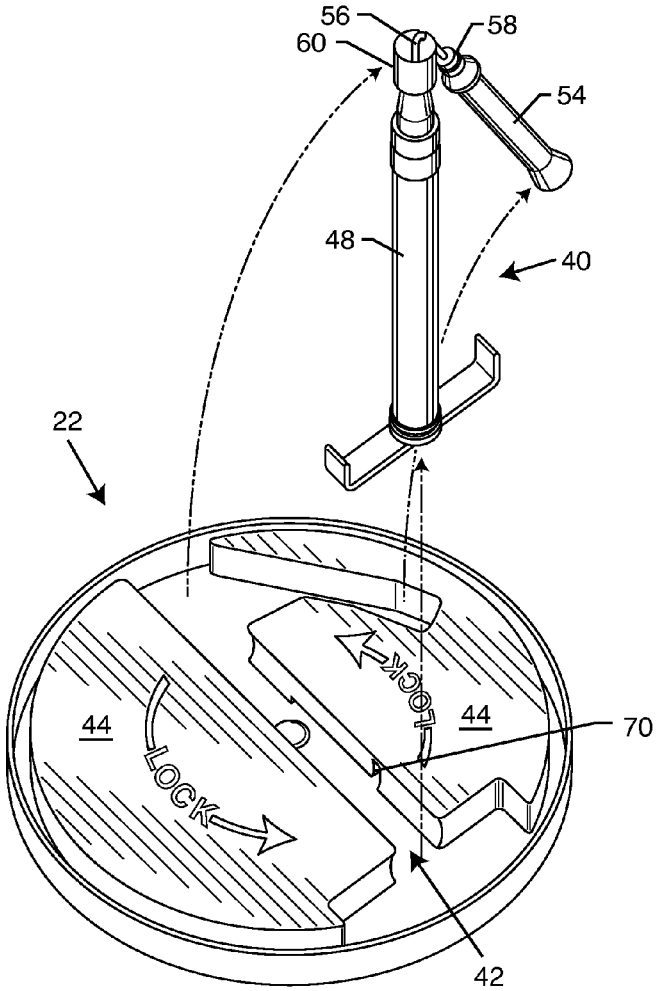
FIG. 6 is an exploded perspective view of the lid and batting tee, prior to assembly into a second configuration for use.
Figure 7:
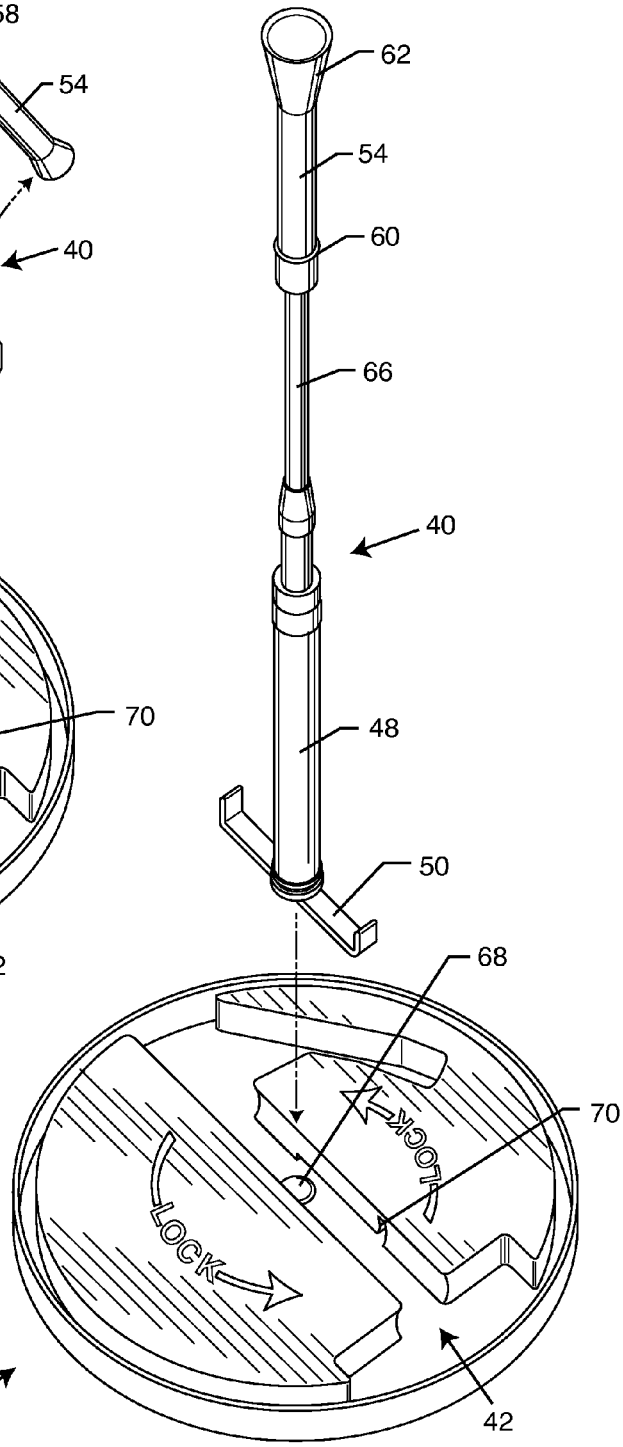
FIG. 7 is a further exploded perspective view similar to FIG. 6.
Figure 9:
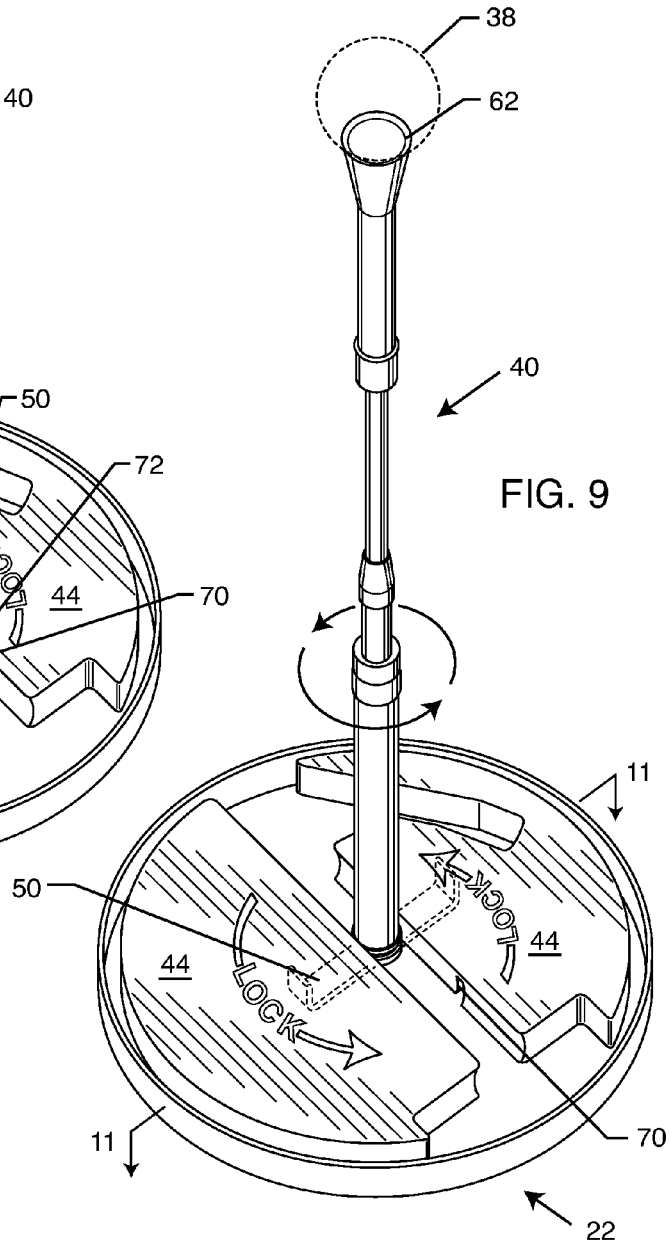
FIG. 9 is a perspective view similar to FIG. 8, illustrating rotational engagement of the tee within the lid.

Referring now to FIG. 5, the batting tee 40 itself comprises a base 50 that engages the main body 48 via a coupler 52. The coupler 52 may encompass a screw-type, snap-fit, or other coupling known in the art for securely attaching the base 50 to the main body 48. The base 50 may be removably attached or fixedly attached to the main body 48. As best shown in FIGS. 6 and 7, the batting tee 40 further includes an upper body 54 interconnected to the main body 48 via a cord 56. The cord 56 allows the upper body 54 to remain attached to the main body 48 even after disconnecting the upper body 54 from the main body 48 via the connector 58. The cord 56 enables the upper body 54 to bend at an angle relative to the main body 48 of the batting tee 40. This design enables the batting tee 40 to further collapse for storage within the lid 22, as shown in FIGS. 2-4. The batting tee 40 could also be designed wherein the upper body 54 is completely telescopingly received within the interior of the main body 48 such that the cord 56 and angular configuration of the lid 22 (FIGS. 6 and 7) is not required. But, in the preferred embodiment, the upper body 54 has a diameter as large as, if not greater than, the main body 48. This is important as the upper body 54 must be able to withstand direct contact with a baseball bat or other substantially rigid object used to strike the ball 38 (FIG. 9).

The assembled batting tee 40 is shown in FIG. 7. In this embodiment, the upper body 54 is snapped into or otherwise interconnected with the main body 48 via a connector 58. This is accomplished by bending the upper body 54 about the substantially flexible elastomeric cord 56 for placement of the connector 58 into an upper portion 60 of the main body 48. The connector 58 may encompass a variety of designs that include a snap-fit arrangement or other frictional or slide-fit mechanisms. The connector 58 is designed to allow the main body 48 to retain the upper body 54 in a substantially upright and rigid configuration as generally shown in FIG. 7. The important aspect is that the upper body 54 remains substantially retained in an upright position concentric with the main body 48. Furthermore, the connector 58 is incorporated into the present invention to allow the batting tee 40 to be collapsed and retained within the retainment channel 42 formed between the location blocks 44 of the lid 22. The batting tee 40 as shown in FIGS. 3-5 provides a compact design that is easily portable.

The upper body 54 of the batting tee 40 further includes a ball holder 62 integral thereto. The ball 38 is shown in phantom in FIG. 9 as residing within the concave portion of the ball holder 62. The ball holder 62 is preferably a cylindrical tube having an inverted frusto-conical end capable of receiving a variety of balls, as previously listed. Of course, a person of ordinary skill in the art will readily recognize that the ball holder 62 may be formed from any one of a variety of different configurations, shapes, or materials. Preferably, the ball holder 62 is made from rubber or plastic. Accordingly, the ball holder 62 slightly deforms to fit snugly within an upper body retainment chamber 64 when the batting tee 40 is placed within the retainment channel 42 of the lid 22. The upper body retainment chamber 64 in combination with the retainment channel 42 ensures that the batting tee 40 remains within the lid 22 as shown in FIGS. 2 and 3, especially when the lid is turned upside down and connected to the housing 24. This ensures that the batting tee 40 does not dislodge from either the retainment channel 42 or the upper body retainment chamber 64. Thus, the batting tee 40 remains unobstructive to the volume formed by the interior chamber 36. Accordingly, there is more room within the interior chamber 36 for storage of a plurality of balls 38 as generally shown in phantom in FIG. 2. Of course, the balls are individually removable from the interior chamber 36 of the housing 24 after the lid 22 is removed therefrom.

The batting tee 40, once fully assembled as shown in FIG. 7, is selectively movable between a retracted position and an extended position. Specifically, the main body 48 includes a selectably extendable extension 66 that may be telescopingly extracted from within the interior of the main body 48. The telescoping extension 66 allows the batting tee 40 to be selectively movable to any one of a plurality of intermediate positions between the fully retracted position (FIG. 6) and fully extended position (FIG. 7). Accordingly, extracting the extension 66 from within the main body 48 enables a user to adjust the height of the ball holder 62 according to the size and needs of the user. The upper body 54 is held relative to the main body 48 by press-fit engagement or other mechanical means of retaining the upper body 54 relative to the main body 48, such as by friction fit.

Figure 8:
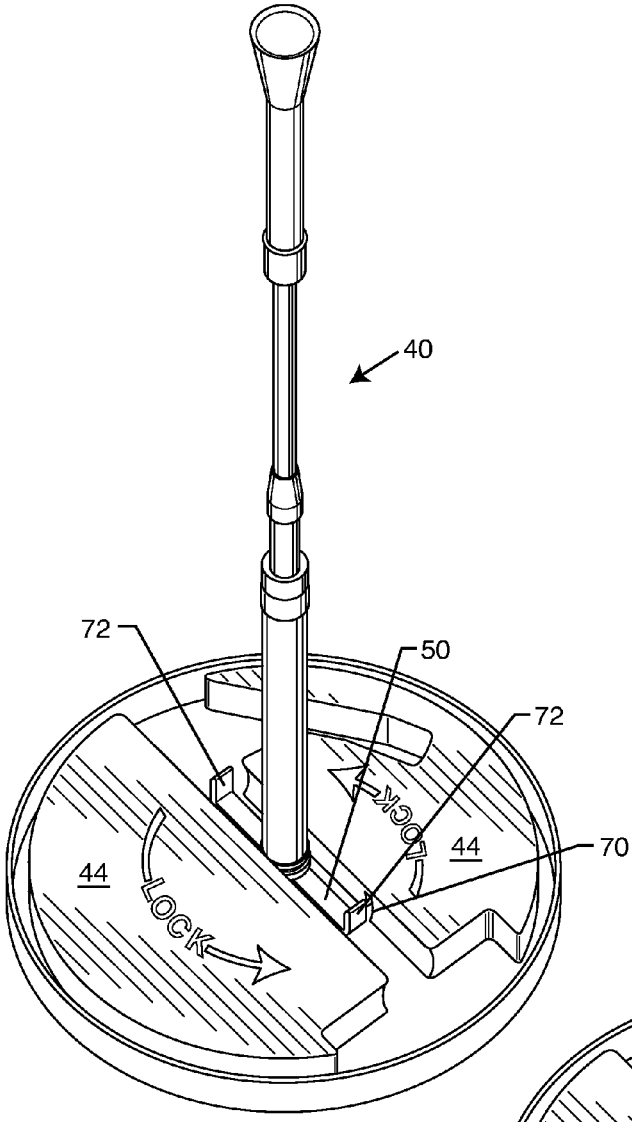
FIG. 8 is a perspective view showing the tee placed on the lid.

As shown in FIGS. 7-9, the fully assembled batting tee 40 engages the lid 22 via the location blocks 44 for use. As shown in FIG. 7, the lid 22 includes a locking button 68 residing within the retainment channel 42. The shaft of the batting tee 40 is concentrically located over the locking button 68 as generally shown in FIG. 7. The locking button 68 is depressable to enable the base 50 to slide into a pair of block channels 70 formed in the location blocks 44. Absent depressing the locking button 68, a pair of flanges 72 formed perpendicular to the base 50 would not otherwise fit into the block channels 70.

Figure 10:
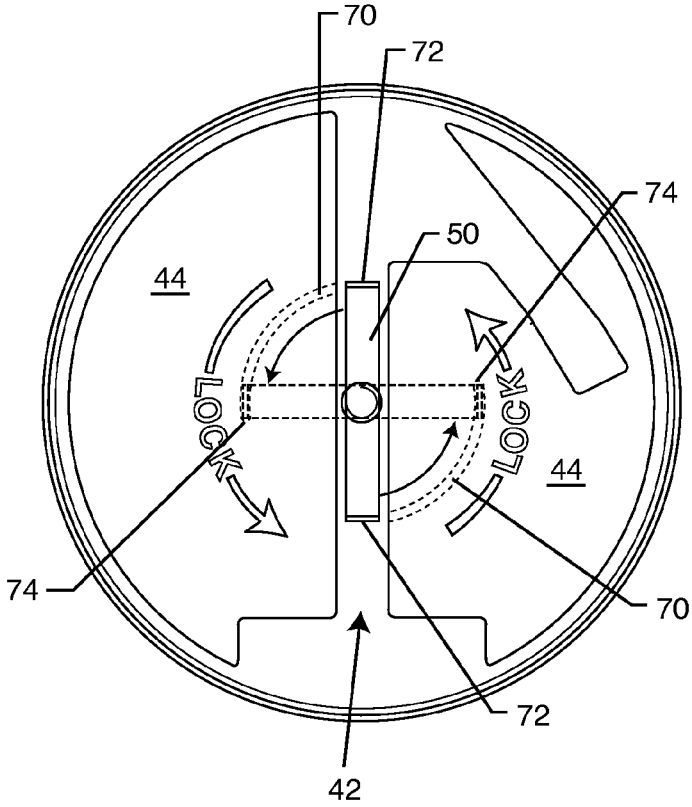
FIG. 10 is a top view of the lid and tee assembly of FIGS. 8 and 9, further illustrating rotational engagement of the batting tee within the lid.
Figure 11:
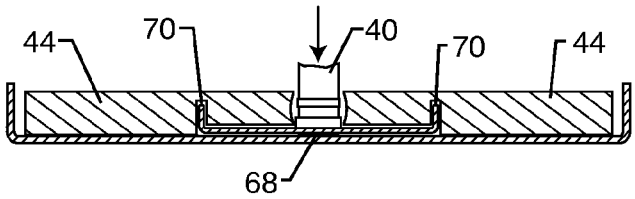
FIG. 11 is a sectional view of the lid taken generally along the line 11-11 in FIG. 9, illustrating engagement of the tee to the lid prior to locking.
Figure 12:
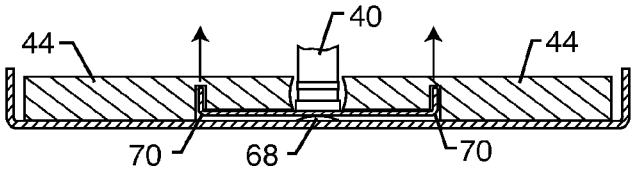
FIG. 12 is a sectional view similar to of FIG. 11, illustrating the tee locked to the lid to resist rotation therein.

Once the base 50 depresses the locking button 68, the entire batting tee 40 may be rotated counterclockwise as generally shown by the directional arrows in FIG. 9. In doing so, the base 50 and corresponding flanges 72 enter the block channels 70 for retention of the entire batting tee 40 therein. Of course, the lid 22 and corresponding block channels 70 may be configured such that clockwise rotation would engage the base 50 within the location blocks 44. FIG. 10 further illustrates the rotation of the base 50 from an initial position in the retainment channel 42 (identified in phantom) to the locked position wherein the base 50 is retained within each of the location blocks 44. To lock the base 50 in the lid 22, the base 50 is rotated to a pair of termination points 74 within the block channels 70. Release of the depressed tee allows the locking button 68 to pop back up as shown generally between FIGS. 11 and 12. The base 50 and corresponding batting tee 40 is thereafter retained within the location blocks 44 for use of the batting tee 40. The base 50 can only be disengaged by depressing the locking button 68. Only then may the base 50 and corresponding flanges 72 rotate out from within the block channels 70.

The width of the lid 22 should be sufficient to prevent the attached batting tee 40 from tipping over during use. For example, the moment generated through contact of a bat or other apparatus against the ball holder 62 should not generate enough force to tip the batting tee 40 when attached to the lid 22. The lid 22 could also be weighted, although not preferred, to counteract such a moment.

FIG. 9 shows the ball holder 62 with a ball 38 thereupon. Placement of the ball 38 on the ball holder 62 allows the baseball swing training aid 20 to provide an easy and convenient way to practice batting. The ball holder 62 is preferably formed from a flexible material such as rubber, plastic, or the like so any bat contact with the ball holder 62 during a swing does not actually break the material comprising the ball holder 62.

The baseball swing training aid 20 of the present invention provides an easy and convenient way of storing a plurality of balls within a container without interference of the corresponding tee. The interlocking assembly of the lid 22 and the batting tee 40 shown in FIG. 9 is easily and quickly disassembled by depressing the base 50 into the locking button 68 and rotating the batting tee 40 clockwise until the base 50 and corresponding flanges 72 exit the block channels 70. The extension 66 is then telescopingly retracted back into the interior of the main body 48. The upper body 54 is disengaged from the main body 48 via the connector 58. The cord 56 allows the upper body 54 to bend relative to the main body 48 for angled placement back within the retainment channel 42 and corresponding upper body retainment chamber 64. Once the batting tee 40 is re-engaged into the lid 22, the lid 22 may be reconnected to the housing 24 for easy portability and storage for later use.

While the baseball swing training aid 20 has been described in the context of a baseball or softball, the training aid 20 is equally applicable with other types of balls, including wiffle balls or the like.

Although several embodiments have been described in detail for purposes of illustration, various modifications may be made without departing from the scope and spirit of the invention. Accordingly, the invention is not to be limited, except as by the appended claims.

What is claimed is:

1. A baseball swing training aid, comprising: a ball bucket having a cavity for storing a plurality of balls therein; a lid for the bucket; and a batting tee comprising a base, a ball cradle and an elongated member extending from the base to the ball cradle;

wherein the batting tee is stowable on an underside of the lid in a first configuration such that the batting tee does not interfere with the lid's attachment to the bucket;

wherein the lid includes a channel for receiving the elongated member when the batting tee is stowed in the first configuration; and wherein the batting tee is attachable to the lid in a second configuration such that the elongated member extends upwardly from the base to position the ball cradle at a desired height for baseball swing training.

2. The baseball swing training aid of claim 1, wherein the channel retains the tee by snap-fit or friction-fit engagement.

3. The baseball swing training aid of claim 1, wherein the elongated member includes a top portion selectively separable from a bottom portion.

4. The baseball swing training aid of claim 3, wherein in the first configuration, the top and bottom portions of the elongated member reside within a pair of channels formed on the underside of the lid.

5. The baseball swing training aid of claim 4, wherein the ball cradle is deformable for fitting within one of the channels.

6. The baseball swing training aid of claim 3, including an elastomeric cord for interconnecting the top and bottom portions of the elongated member.

7. The baseball swing training aid of claim 1, wherein the lid removably engages the bucket by a screw-tight, snap-fit or friction-fit coupling.

8. The baseball swing training aid of claim 1, wherein in the second configuration, the base is disposed within a slot formed in the underside of the lid.

9. The baseball swing training aid of claim 8, including a lock for securing the base within the slot.

10. The baseball swing training aid of claim 9, wherein the lock comprises a depressible button located under the base and concentric to the elongated member, wherein depressing the button unlocks the base within the slot and enables rotational movement of the elongated member therein.

11. The baseball swing training aid of claim 8, wherein counterclockwise rotation of the elongated member disengages the base from the slot.

12. The baseball swing training aid of claim 1, wherein the base includes a pair of flanges for aligning the base with the slot.

13. The baseball swing training aid of claim 1, wherein the length of the elongated member adjustable.

14. A baseball swing training aid, comprising:

a ball bucket having a cavity for storing a plurality of balls therein;

a lid for the bucket; and a batting tee comprising a base, a ball cradle and an adjustable elongated member extending from the base to the ball cradle;

wherein the batting tee is stowable in a channel on an underside of the lid for receiving the elongated member in a first configuration such that the batting tee does not interfere with the lid's attachment to the bucket; and wherein the batting tee is attachable to the lid in a second configuration by disposing the base within a slot formed in the underside of the lid such that the elongated member extends upwardly from the base to position the ball cradle at a desired height for baseball swing training.

15. The baseball swing training aid of claim 14, wherein the channel retains the tee by snap-fit or friction-fit engagement.

16. The baseball swing training aid of claim 14, wherein the elongated member includes an elastomeric cord for interconnecting a top portion selectively separable from a bottom portion, wherein in the first configuration, the top and bottom portions of the elongated member reside within a pair of channels formed on the underside of the lid wherein the ball cradle is deformable for fitting within one of the channels.

17. The baseball swing training aid of claim 14, including a lock comprising a depressible button located under the base and concentric to the elongated member in the second configuration for securing the base within the slot, wherein depressing the button unlocks the base within the slot and enables rotational movement of the elongated member therein such that counterclockwise rotation disengages the base from the slot.

18. A baseball swing training aid, comprising:

a ball bucket;

a lid for the bucket; and a batting tee comprising a base, a deformable ball cradle and an adjustable elongated member extending from the base to the ball cradle, including an elastomeric cord for interconnecting a top portion selectively separable from a bottom portion of the elongated member;

wherein the batting tee is stowable in a pair of channels for receiving the top and bottom portions of the elongated member and the ball cradle on an underside of the lid by snap-fit or friction-fit engagement in a first configuration such that the batting tee does not interfere with the lid's attachment to the bucket; and wherein the batting tee is attachable to the lid in a second configuration by disposing the base within a slot formed in the underside of the lid such that a depressible button located under the base and concentric to the elongated member secures the base within the slot so the elongated member extends upwardly from the base to position the ball cradle at a desired height for baseball swing training, wherein depressing the button unlocks the base within the slot and enables rotational movement of the elongated member therein such that counterclockwise rotation of the elongated member disengages the base from the slot.

* * * * *